United States Patent [19]

Klemow

[11] Patent Number: 4,863,020

[45] Date of Patent: Sep. 5, 1989

[54] SPARK PLUG WIRE HANGER DEVICE

[76] Inventor: Jerry R. Klemow, 6550 Azalea, Dallas, Tex. 75230

[21] Appl. No.: 172,508

[22] Filed: Mar. 24, 1988

[51] Int. Cl.[4] ..... B65D 75/62

[52] U.S. Cl. ..... 206/328; 206/486; 206/806; 211/60.1; 211/113

[58] Field of Search ..... 206/328–331, 206/332, 477–480, 483, 485–490, 806, 493, 495; 211/60.1, 113

[56] References Cited

U.S. PATENT DOCUMENTS

| | | | |
|---|---|---|---|
| 1,734,032 | 11/1929 | Evans | 206/486 |
| 2,639,081 | 5/1953 | Metzger | 206/488 |
| 3,072,986 | 1/1963 | Lefnaer . | |
| 3,147,523 | 9/1964 | Logan . | |
| 3,215,385 | 11/1965 | Rockland | 211/113 |
| 4,019,632 | 4/1977 | Greenlee . | |
| 4,061,229 | 12/1977 | Ohtsuka . | |
| 4,450,961 | 5/1984 | Bies et al. . | |
| 4,510,649 | 4/1985 | Yudis et al. . | |
| 4,531,638 | 7/1985 | Jacobozzi et al. . | |
| 4,706,804 | 11/1987 | Hall | 206/490 |

FOREIGN PATENT DOCUMENTS

| | | | |
|---|---|---|---|
| 0658784 | 6/1929 | France | 206/486 |

*Primary Examiner*—Jimmy G. Foster
*Attorney, Agent, or Firm*—Thompson & Knight

[57] ABSTRACT

A hanger device for the display of individual spark plug wires at the point of sale. The hanger device is formed of relatively thin, flat rectangular piece of resilient plastic sheet material, having a hole at its upper portion for engaging a hook or rod of conventional wire display racks. The hanger device also has a vertical slit extending down the middle of approximately two-thirds the length of said hanger device and terminating in a second hole at the bottom portion of the hanger device, the dimensions of the second hole corresponding to the outside diamter of the insulated electrical conductor of a spark plug wire. The portions of the hanger device opposite the slit are deformable to selectively present an opening of sufficient size to permit the insulating boot of a spark plug wire to be inserted therethrough. Once a spark plug wire has been inserted into the hanger device, the resiliency of the material from which the hanger device is made cause the portions adjacent the slit to return to their relaxed state, causing hanger device to fit snugly around the insulated electrical conductor securely coupling the hanger device to the spark plug wire.

10 Claims, 2 Drawing Sheets

SPARK PLUG WIRE HANGER DEVICE

BACKGROUND OF THE INVENTION

This invention relates to the display of individual spark plug wires at the point of sale. More particularly, the invention relates to a hanger device that securely couples to the spark plug wire for display thereof at the point of sale.

Spark plug wires are usually sold in complete sets, displayed at the point of sale in boxes or other packaging in which the wire sets are transported and stored. This method of display has certain disadvantages that detract from the marketing appeal of the product. One disadvantage is that packaging of complete wire sets does not readily accommodate the separate display and sale of individual spark plug wires. Another disadvantage is that the individual spark plug wires are not easily seen by prospective purchasers and cannot be easily handled and manipulated. Further still, it is not uncommon for a single spark plug wire to fail during use, thereby necessitating the purchase of an individual wire as opposed to a complete wire set. Accordingly, more and more spark plug wire manufacturers offer consumers the option of buying either individual spark plug wires or complete spark plug wire sets.

Spark plug wires come in a variety of shapes and sizes. The length of a particular spark plug wire, as well as the shape and size of the electrical connectors and insulators provided at each end thereof depend upon the particular vehicle for which the spark plug wire is designed. Because individual spark plug wires typically do not bear any markings identifying the wire or the particular vehicle for which the wire is designed, such identification is typically provided on a tag attached to the wire. If several different spark plug wires are inadvertently separated from their identifying tags during packaging, shipping or display, it can be very difficult to identify each model of spark plug wire and be certain of its application, without painstakingly measuring each one or comparing each one to known wires. It is, thus, critical that the hanger device be designed in such a manner to permit identifying information to be printed thereon and to prevent inadvertent separation of the hanger device from the spark plug wire during packaging, shipment or display thereof. The hanger device should also be simple and inexpensive to manufacture.

The device of the present invention resolves the difficulties indicated above and affords other features and advantages heretofore not obtainable.

SUMMARY OF THE INVENTION

An object of the invention is to provide an inexpensive and efficient hanger device that permits the display of individual spark plug wires at the point of purchase.

Another object of the invention is to provide a hanger device for individual spark plug wires that prevents inadvertent separation of the hanger device from the spark plug wire during packaging, shipment and display thereof.

Another object of the invention is to provide a hanger device that permits individual spark plug wires to be handled and manipulated by a customer at the point of sale.

A further object of the invention is to provide a hanger device that permits sales and identifying information to be displayed with the individual spark plug wires.

Yet another object of the invention is to provide a display rack for the display of individual spark plug wires at point of sale.

These and other objects and advantages are accomplished with the invention, which is formed of a rectangular piece of a relatively thin flat resilient plastic sheet material and has a hole at the upper end to permit hanging of the device on a hook or a rod. The device also has a vertical slit extending down the middle thereof and terminating in another hole at its lower portion, which hole is of sufficient size to snugly fit around the outside of the insulated electrical conductor of a spark plug wire. The portions of the hanger device adjacent to the slit are deformable so as to selectively present an opening large enough to permit the boot of a spark plug wire to be inserted therethrough and the insulated electrical conductor of the spark plug wire to be positioned within the hole at the lower portion of the hanger device. With the insulated electrical conductor thus positioned, the resiliency of the plastic material of the hanger device causes the portions adjacent the slit to return to their relaxed state, thereby securely coupling the hanger device to the spark plug wire.

DESCRIPTION OF THE PREFERRED EMBODIMENT

Reference is now made to the figures wherein like parts are designated with like numericals throughout.

Figure 1:
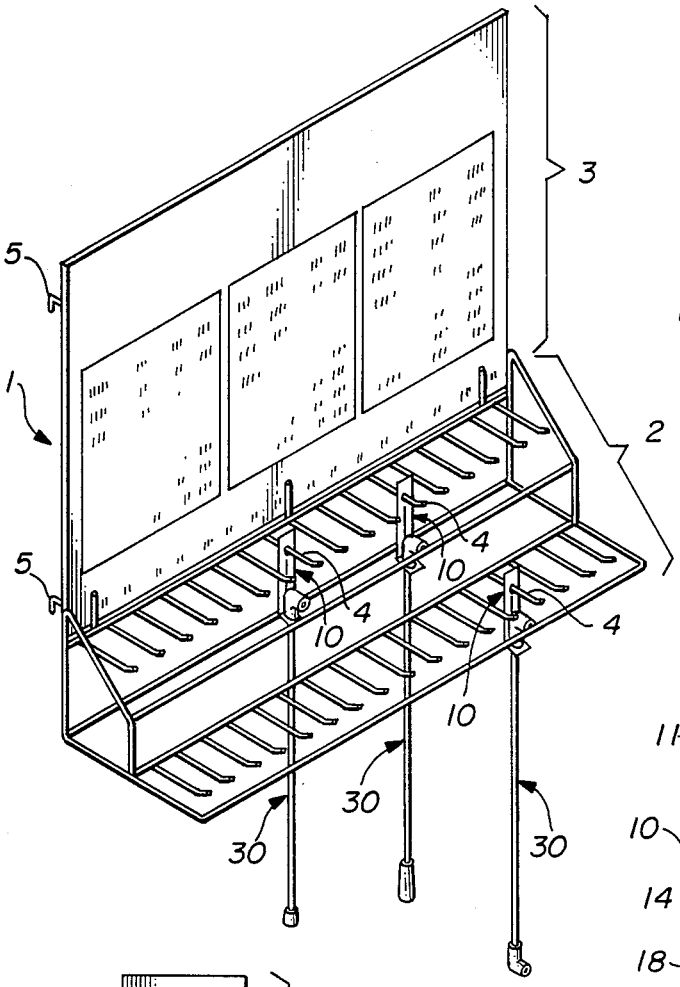
FIG. 1 is a perspective view of a display rack illustrating a plurality of spark plug wires of differing lengths and sizes supported on the rack through the use of hanger devices of the present invention.

FIG. 1 illustrates a point of purchase display 1 in connection with which the hanger device 10 of the present invention may be used. Display 1 has a rack portion 2 and a printed portion 3. Rack portion 2 has a plurality of rods 4 that extend outward, essentially perpendicular in relation to printed portion 3. A plurality of spark plug wires 30 of differing lengths and sizes may be displayed on display 1. Spark plug wires 30 are securely coupled (as described below) to hanger devices 10, which in turn are supported on rods 4. Printed portion 3 presents an essentially flat surface on which graphics and other printed matter may be displayed. Printed portion 3 preferably includes a selection guide to assist the consumer in selecting the proper spark plug wire for a particular make and model of automobile. The manufacture and construction of display 1 is well known to those skilled in the art, may be constructed of a variety of materials, and may be either free standing or wall mounted. The illustrated embodiment of display, 1 is a wall mounted version, which includes hooks 5 that are configured to engage, and be supported by, standard peg board (not shown).

Figure 2:
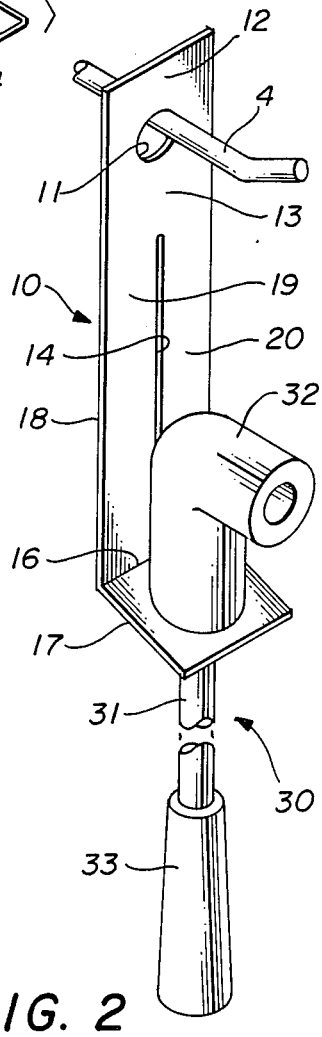
FIG. 2 is a perspective view of a spark plug wire coupled to a hanger device in accordance with the invention, the hanger device and spark plug wire being supported on a hook.

FIG. 2 illustrates a single spark plug wire 30 coupled to a hanger device 10. Spark plug wire 30 has an elongated, insulated electrical conductor 31 which is electrically coupled to metallic terminals (not shown) at each end of conductor 31. Surrounding the metallic terminals are enlarged insulating boots 32 and 33. The manufacture and construction of spark plug wire 30 is well known to those skilled in the art. It will be understood, of course, that whereas a spark plug wire with angled boots is illustrated herein, other shapes and sizes of boots may be used with the invention.

Figure 3:
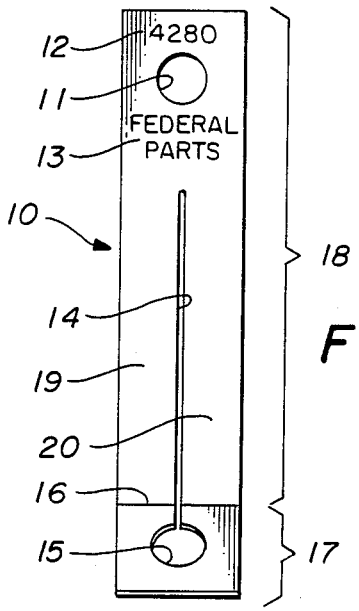
FIG. 3 is an elevational view of a hanger device embodying the invention.

Referring to FIGS. 2 and 3, hanger device 10 is formed of a rectangular piece of relatively flat, flexible plastic sheet material. In the preferred embodiment, the dimensions of device 10 are approximately 5¼ inches tall, approximately ⅞ inches wide, and approximately ½ millimeter thick, and the material used is 20 mil rigid vinyl. Device 10 has a hole 11 in the upper portion thereof to permit the device to be hung on a hook or rod such as rod 4. In the preferred embodiment, the diameter of hole 11 is approximately 8 millimeters. Adjacent hole 11, both above and below, are essentially flat surfaces 12 and 13, respectively, on which model number designations and other information may be printed. In the preferred embodiment, a model number corresponding to the model number of the spark plug wire to be displayed therewith is printed on surface 12 and the identity of the manufacturer is printed on surface 13, as illustrated in FIG. 3. Device 10 also has an elongated vertical slit 14 extending down the middle of approximately two-thirds the length of device 10 and terminating in another hole 15 at the bottom portion of device 10. In the preferred embodiment, the length of slit 14 is approximately 3⅛ inches long. The diameter of hole 15 corresponds approximately to the outside diameter of insulated electrical conductor 31. In the preferred embodiment, the diameter of hole 15 is approximately 8 millimeters. Device 10 also has a lineal depression 16 across the entire width near the bottom of device 10, just above hole 15. In the preferred embodiment, depression 16 is located approximately ⅝ of an inch from the bottom of device 10. A bend is formed in device 10 at depression 16 such that the bottom portion 17 of device 10 forms an obtuse angle with the upper portion 18 of device 10. Depression 16 may be scored or pressed into device 10 and helps retain the bend in device 10. The angle formed in device 10 between bottom portion 17 and upper portion 18 causes spark plug wires 30 to hang in an essentially vertical orientation when displayed on display 1, which helps to prevent the individual spark plug wires 30 from becoming tangled.

Figure 4:
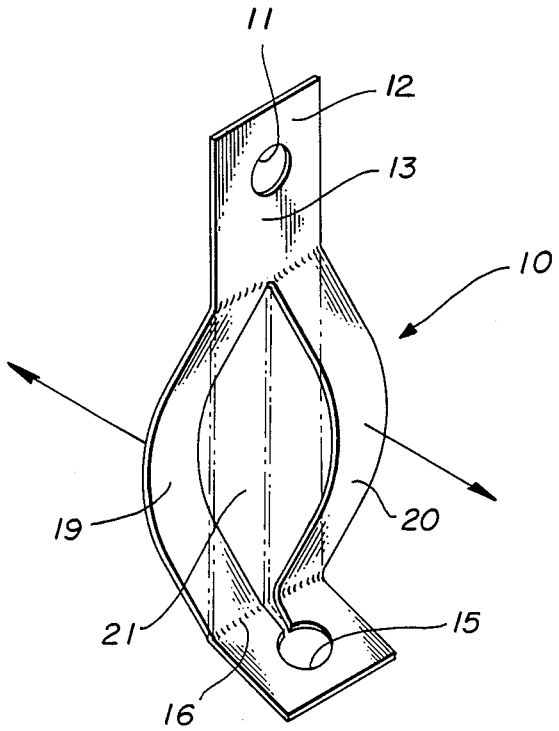
FIG. 4 is a perspective view of a hanger device embodying the invention being deformed to permit insertion of the insulating boot of a spark plug wire.

In the assembly of and device 10 and spark plug wire 30, portions 19 and 20 of device 10 that are adjacent slit 14 are deformed in opposite directions relative to one another, as illustrated in FIG. 4, so as to present opening 21 through which either insulating boot 32 or 33 can be inserted. After inserting insulating boot 32 or 33 through opening 21, insulated electrical conductor 31 is positioned within hole 15. Once insulated electrical conductor 31 is positioned within hole 15, portions 19 and 20 are released and the resiliency of the plastic sheet material from which device 10 is made causes portions 19 and 20 to return to their relaxed state, closing the opening 21 through which boot 32 or 33 was inserted and thereby securely coupling device 10 to wire 30.

With the spark plug wire 30 held and displayed in this manner, a prospective customer may handle, manipulate and otherwise carefully inspect the product at the point of sale. The hanger device 10, however, snugly surrounds the insulated electrical conductor 31 and thus is securely coupled to spark plug wire 30, preventing inadvertent separation of hanger device 10 from spark plug wire 30. The resiliency of the plastic sheet material of device 10 further inhibits inadvertent separation of device 10 and wire 30.

The invention may be embodied in other specific forms without departing from its spirit or central characteristics. The described embodiment is to be considered in all respects only as illustrative and not restrictive, and the scope of the invention is, therefore, indicated by the appended claims rather than by the foregoing description. All changes which come within the meaning and range of equivalency of the claims are to be embraced within their scope.

I claim:

1. A spark plug wire hanger device comprising a rectangular piece of essentially flat, resilient material, having a first means defining a hole at the upper portion of said device, a second means defining a hole at the bottom portion of said device, a third means defining a slit in communication with said second means and extending up the middle of said device a sufficient distance that the portions of said device adjacent said third means are deformable to selectively present an opening of sufficient size to permit the insertion of an insulating boot of a spark plug wire therethrough, and a spark plug wire having an elongated electrical conductor, at least one end of which terminates in an enlarged insulating boot, said spark plug wire being positioned within said second means such that said second means snuggly surrounds said elongated electrical conductor adjacent said enlarged insulating boot.

2. The spark plug wire hanger device of claim 1 further comprising a lineal depression across the entire width of said hanger device, said depression being located just above said second means, and wherein the portion of said hanger device below said lineal depression is bent forward to form an obtuse angle in relation to the portion of said hanger device above said lineal depression.

3. The spark plug wire hanger device of claim 2 wherein said device is made of vinyl.

4. The spark plug wire hanger device of claim 2 wherein said device is made of 20 mil rigid vinyl.

5. A spark plug wire display comprising:

a display rack having a plurality of spaced apart rods extending outward; and a hanger device being formed of a rectangular piece of essentially flat, resilient vinyl material having a first means defining a hole in its upper portion for hanging said device and said spark plug wire on said rods of said display rack, said hanger device also having second means defining a vertical slit extending down the middle of approximately two-thirds the length of said hanger device and terminating in a third means defining a hole with a diameter corresponding to the outside diameter of said insulated electrical conductor, the portions of said hanger device adjacent said second means being deformable to selectively present an opening of sufficient size to enable one of said insulating boots of said spark plug wire to be inserted therethrough, and the resiliency of said hanger device causing said portions to return to their relaxed state and to retain and secure said spark plug wire to said hanger device.

6. The spark plug display of claim 5 wherein said display rack includes an essentially flat portion for display of graphics and other printed matter thereon.

7. The spark plug display of claim 5 wherein said hanger device includes a lineal depression across the entire width of said hanger device, said depression being located just above said second means, and wherein the portion of said hanger device below said depression is bent forward to form an obtuse angle in relation to the portion of said hanger device above said depression.

8. The spark plug display of claim 7 wherein said hanger device is made of 20 mil rigid vinyl.

9. In combination a spark plug wire and a hanger device therefor, said park plug wire having an elongated insulated electrical conductor and enlarged insulating boots connected to each end thereof; and said hanger device being formed of a rectangular piece of essentially flat, resilient vinyl material having a first means defining a hole in its upper portion for hanging said device and said spark plug wire on a hook, said hanger device also having second means defining a vertical slit extending down the middle of approximately two-thirds the length of said hanger device and terminating in a third means defining a hole with a diameter corresponding to the outside diameter of said insulated electrical conductor, the portions of said hanger device adjacent said second means being deformable to selectively present an opening of sufficient size to enable one of said insulating boots of said spark plug wire to be inserted therethrough, and the resiliency of said hanger device causing said portions to return to their relaxed state and to retain and secure said spark plug wire to said hanger device.

10. In combination a spark plug wire, a hanger device, and a display, said spark plug wire having an elongated insulated electrical conductor and enlarged insulating boots connected to each end thereof, said display having an essentially flat printed portion for display of graphics and other printed matter thereon and said display also having a rack portion with a plurality of spaced apart rods extending outward, essentially perpendicular to said printed portion, and said hanger device being formed of a rectangular piece of essentially flat, resilient vinyl material having a first means defining a hole in its upper portion for hanging said device and said spark plug lead on said rods of said display, said hanger device also having second means defining a vertical slit extending down the middle of approximately two-thirds the length of said hanger device and terminating in a third means defining a hole with a diameter corresponding to the outside diameter of said insulated electrical conductor, the portions of said hanger device adjacent said second means being deformable to selectively present an opening of sufficient size to enable one of said insulating boots of said spark plug wire to be inserted therethrough, and the resiliency of said hanger device causing.said portions to return to their relaxed state and to retain and secure said spark plug wire to said hanger device.

* * * * *